US008919049B2

(12) United States Patent
Meserini

(10) Patent No.: US 8,919,049 B2
(45) Date of Patent: Dec. 30, 2014

(54) PREFABRICATED TEMPORARY HOUSE ADDITION

(76) Inventor: Rick M. Meserini, North Olmsted, OH (US)

( * ) Notice: Subject to any disclaimer, the term of this patent is extended or adjusted under 35 U.S.C. 154(b) by 0 days.

(21) Appl. No.: 12/861,825

(22) Filed: Aug. 23, 2010

(65) Prior Publication Data

US 2011/0041418 A1 Feb. 24, 2011

Related U.S. Application Data

(60) Provisional application No. 61/236,075, filed on Aug. 21, 2009.

(51) Int. Cl.

| | |
|---|---|
| ***E04H 7/02*** | (2006.01) |
| ***E04H 7/22*** | (2006.01) |
| ***E04H 1/02*** | (2006.01) |
| ***E03C 1/01*** | (2006.01) |
| ***E04B 1/343*** | (2006.01) |
| ***E04B 1/348*** | (2006.01) |

(52) U.S. Cl.

CPC .. *E04H 1/02* (2013.01); *E03C 1/01* (2013.01); *E04B 1/34336* (2013.01); *E04B 1/34869* (2013.01)

USPC ..... 52/79.6; 52/79.9; 52/143; 52/79.1; 52/79.5

(58) Field of Classification Search

CPC ..... E04H 1/02; E04H 1/00; E04H 7/02; E04H 7/22

USPC ..... 52/66, 67, 72, 64, 73, 79.5, 79.6, 79.7, 52/79.9, 79.1, 143

See application file for complete search history.

(56) References Cited

U.S. PATENT DOCUMENTS

| | | | | | |
|---|---|---|---|---|---|
| 465,900 | A | * | 12/1891 | Walker | 52/169.6 |
| 1,739,622 | A | | 12/1927 | Wallace | |
| 2,037,895 | A | | 4/1936 | Gugler | |
| 2,644,203 | A | * | 7/1953 | Donahue | 52/34 |
| 2,817,091 | A | | 12/1957 | Painter | |
| 3,110,907 | A | | 11/1963 | King | |
| 3,162,863 | A | * | 12/1964 | Wokas | 52/34 |
| 3,256,896 | A | * | 6/1966 | Cummins | 135/131 |
| 3,463,540 | A | * | 8/1969 | Carr | 296/161 |
| 3,636,676 | A | * | 1/1972 | Moss | 52/745.08 |
| 3,675,380 | A | * | 7/1972 | Moss | 52/81.4 |
| 3,763,608 | A | * | 10/1973 | Chamlee | 52/81.4 |
| 3,999,337 | A | * | 12/1976 | Tomassetti et al. | 52/82 |
| 4,133,571 | A | * | 1/1979 | Fillios | 296/165 |
| 4,192,544 | A | * | 3/1980 | Patterson | 296/165 |
| 4,238,858 | A | | 12/1980 | Maihart | |

(Continued)

*Primary Examiner* — Phi A

(74) *Attorney, Agent, or Firm* — D.A. Stauffer Patent Services LLC

(57) ABSTRACT

A prefabricated, transportable, ADA compliant, temporary addition, providing ADA accessible bathing, hygiene, and optional laundry facilities to the disabled occupants, eliminating the need to negotiate stairs to access a second floor bath or basement laundry. The addition is designed to be transported, lifted, connected and disconnected multiple times. The addition contains a walk-in shower with grab bars, ADA sink and sink base, tilt mirror, raised toilet with grab bars, egress door, light, heating unit, and exhaust fan. The addition is supported on a foundation of piers and attached to a ground floor room of an existing home by way of a connecting collar, minimizing the surface area connection to the house. The addition is pre-plumbed and wired with plumbing and electrical access points at the base of the addition that are connected to the existing home's utilities through a hole into the basement.

6 Claims, 11 Drawing Sheets

(56) References Cited

U.S. PATENT DOCUMENTS

| | | | | | |
|---|---|---|---|---|---|
| 4,253,283 | A | * | 3/1981 | May | 52/67 |
| 4,557,352 | A | * | 12/1985 | Tschappat, Jr. | 186/37 |
| 4,603,643 | A | * | 8/1986 | Couvrette | 109/24.1 |
| 4,622,787 | A | * | 11/1986 | Scott | 52/58 |
| 4,655,013 | A | * | 4/1987 | Ritland | 52/81.4 |
| 4,667,692 | A | * | 5/1987 | Tury et al. | 135/156 |
| 4,788,802 | A | | 12/1988 | Wokas | |
| 4,838,292 | A | * | 6/1989 | Allen | 135/100 |
| 4,899,402 | A | | 2/1990 | Maynard et al. | |
| 4,928,444 | A | * | 5/1990 | Horie et al. | 52/66 |
| 4,965,970 | A | * | 10/1990 | Nania | 52/82 |
| 5,065,462 | A | | 11/1991 | Romano | |
| 5,106,142 | A | * | 4/1992 | Hegedus | 296/26.02 |
| 5,140,790 | A | * | 8/1992 | Modglin et al. | 52/81.4 |
| 5,171,056 | A | * | 12/1992 | Faludy et al. | 296/163 |
| 5,237,782 | A | * | 8/1993 | Cooper | 52/67 |
| 5,280,687 | A | * | 1/1994 | Boiteau | 52/67 |
| 5,319,904 | A | * | 6/1994 | Pascoe | 52/82 |
| 5,341,610 | A | * | 8/1994 | Moss | 52/82 |
| 5,384,992 | A | * | 1/1995 | Roberton | 52/67 |
| 5,485,701 | A | * | 1/1996 | Hecht | 52/80.1 |
| D370,266 | S | * | 5/1996 | Queen | D25/19 |
| 5,615,623 | A | * | 4/1997 | Capraro, Jr. | 109/2 |
| 5,634,683 | A | * | 6/1997 | Young | 296/165 |
| 5,652,976 | A | | 8/1997 | Hopper | |
| 5,658,032 | A | * | 8/1997 | Gardner | 296/26.01 |
| 5,921,033 | A | * | 7/1999 | Molina | 52/67 |
| 6,108,983 | A | * | 8/2000 | Dewald et al. | 52/67 |
| 6,257,638 | B1 | * | 7/2001 | Graber | 296/26.09 |
| 6,330,766 | B1 | * | 12/2001 | Brownlee, III | 52/173.1 |
| 6,393,769 | B1 | * | 5/2002 | Mertik et al. | 52/7 |
| 6,598,354 | B2 | * | 7/2003 | McManus et al. | 52/67 |
| 6,712,414 | B2 | * | 3/2004 | Morrow | 296/26.01 |
| 6,735,909 | B1 | * | 5/2004 | Gardner | 52/67 |
| 6,966,590 | B1 | * | 11/2005 | Ksiezopolki et al. | 296/26.01 |
| 7,093,888 | B2 | * | 8/2006 | Anderson et al. | 296/162 |
| 7,735,502 | B1 | * | 6/2010 | Hotes | 135/91 |
| D629,917 | S | * | 12/2010 | Kitagawa | D25/35 |
| 7,980,029 | B2 | * | 7/2011 | Ahmedy | 52/71 |
| 8,025,582 | B1 | * | 9/2011 | Gray et al. | 472/77 |
| 8,042,562 | B1 | * | 10/2011 | McDaniel, Jr. | 135/97 |
| 8,074,403 | B1 | * | 12/2011 | Mentnech | 52/72 |
| 8,297,002 | B2 | * | 10/2012 | Fernandez Fernandez | 52/79.9 |
| 2002/0078634 | A1 | * | 6/2002 | McManus et al. | 52/67 |
| 2003/0014927 | A1 | * | 1/2003 | Brooks | 52/66 |
| 2003/0056446 | A1 | * | 3/2003 | Napier | 52/66 |
| 2003/0115808 | A1 | * | 6/2003 | Morrow | 52/64 |
| 2005/0160682 | A1 | * | 7/2005 | Quadrio | 52/67 |
| 2006/0070306 | A1 | * | 4/2006 | Lin | 52/67 |
| 2007/0144078 | A1 | * | 6/2007 | Frondelius | 52/67 |
| 2010/0024314 | A1 | * | 2/2010 | Pope | 52/67 |
| 2010/0024315 | A1 | * | 2/2010 | Pope | 52/67 |
| 2010/0050540 | A1 | * | 3/2010 | Bucher et al. | 52/67 |
| 2010/0139179 | A1 | * | 6/2010 | Smith et al. | 52/67 |
| 2010/0269418 | A1 | * | 10/2010 | Ahmedy | 52/71 |

* cited by examiner

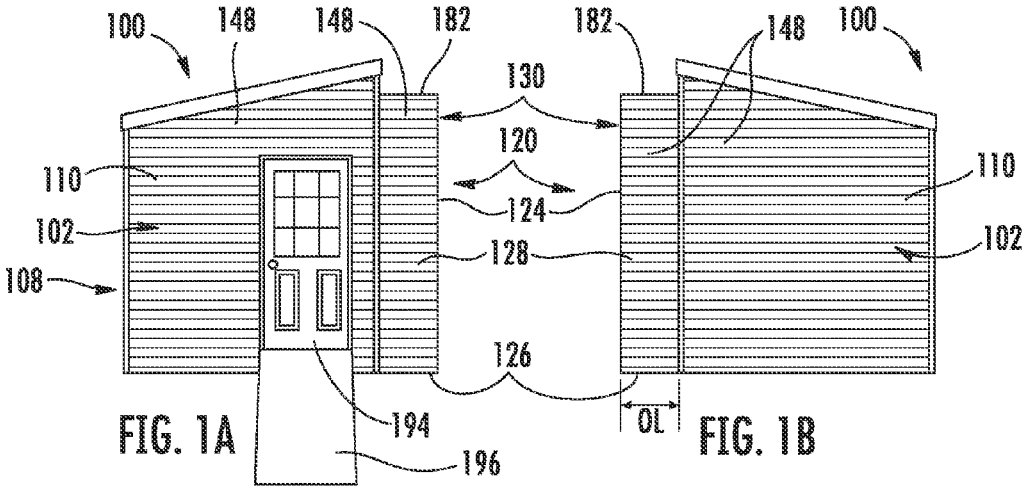
FIG. 1A
FIG. 1B
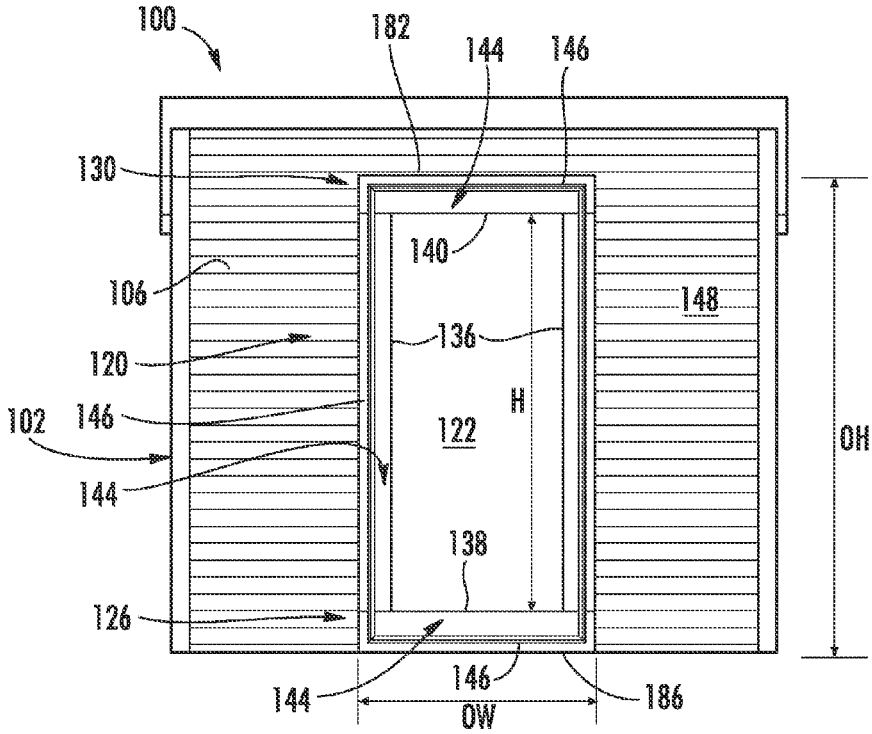
FIG. 1C

PREFABRICATED TEMPORARY HOUSE ADDITION

CROSS-REFERENCE TO RELATED APPLICATIONS

This application claims the benefit of U.S. Provisional Patent Application No. 61/236,075; filed Aug. 21, 2009 by Rick Meserini, the present applicant. The entirety of said Provisional Application is hereby included by reference herein.

TECHNICAL FIELD OF THE INVENTION

The present invention relates to prefabricated housing modules and, more particularly, to said modules that are adapted for simplified installation and removal as a temporary house addition.

BACKGROUND OF THE INVENTION

With the first "baby boomers" turning 65 years of age in 2009, there will be a dramatic increase in the number of elderly with physical limitations (at least partially disabled) but who will be living alone or with a family member in a residence that is multi-leveled such that occupants must negotiate stairs to access important living facilities such as a full bathroom with shower or bathtub, and/or a bedroom/sleeping quarters—which in many homes are located on a second floor level or a split level first floor, while the main living space (e.g., kitchen, living/dining room) is on a ground floor, i.e., the floor closest to ground level, and therefore the most accessible from outside the house. Additionally, in most of such houses laundry facilities are located in a basement or other such lower level that is down stairs from the ground level main living area.

Note: The ground floor is generally referred to as the "first floor" (first level) in the US. The two terms "ground" and "first", as well as "floor" and "level" are treated as equivalent and interchangeable in the present disclosure, in accord with common usage in the US.

Typical age-related disabilities range from medium-term handicaps due to injuries (e.g., a bone broken in a fall) that take longer to heal than for younger people, to essentially permanent disabilities that degenerate from slow and painful walking and stair negotiation to use of a walker, to confinement in a wheelchair and/or a bed. The lack of accessibility to important living facilities increases dependence on others, including family or paid assistance, and increases safety risks such as falls.

Today's elderly, particularly those in the baby boomer generation, are typically used to living independent, self-sufficient and active lives while residing in private residences, and thus strongly desire to continue a similar lifestyle as long as possible, rather than giving up their accustomed living spaces to move into "retirement" facilities for some form of assisted living. The problem is compounded by a culture wherein elderly persons can no longer expect to be able to live with, and be cared for, by younger family members. Typical residential housing is constructed for smaller and younger families. Those elderly who do try to live with extended family are likely to be moving into a relatively small residence that is not equipped to accommodate a person of limited abilities, and/or doesn't have a spare bedroom for them regardless of ability.

Without access to ground floor living facilities, including at least a toilet (lavatory), and preferably also such facilities as a full bathroom with sink and walk-in shower, a laundry (washer and dryer), and/or a private bedroom—all of which can be negotiated with convenience by a disabled resident—it will be difficult to live independently without moving to another more suitably constructed place of residence. This often holds true even for limited ability elderly wishing to stay at home by using part time home health care services.

Thus, there is a substantial, and increasing, need for house modifications suitable for addressing the living facility needs of elderly residents. A house with at least a main floor lavatory can be adapted or even slightly re-modeled for use by a person unable to take stairs, for relatively low cost. However, the space parameters required for adapting a typical residence for wheelchair access and indoor use can turn simple interior remodeling into an overly expensive major reconstruction project, and if the needed reconstruction is structurally impractical or unviable, then an addition to the house may be needed.

Until very recently few, if any, residences were designed and constructed with the needs of disabled or handicapped residents in mind. Thus we have a preponderance of multi-level and split level homes, plus door types, door frame widths, and open spaces in rooms, for example, that do not accommodate wheelchair use.

The Americans with Disabilities Act ("ADA") enacted by the US Federal Government in 1990 provides detailed specifications that are required to make a building and its functional elements "ADA Compliant". Although originally directed toward public-use buildings, the specifications have proved to be very practical and suitable for enabling a disabled person, particularly one who is wheelchair-bound, to move independently and relatively freely in any ADA compliant structure, and to simplify use of facilities therein. For example, specifications enabling wheelchair movement include: 36" (inch) minimum lateral clearance in all but a short portion of passageways and hallways, and a five foot (5') minimum turning radius of clear floor space to allow turning around. Short portions of a passageway, e.g., a doorway, may have a reduced width of 32". For example, specifications enabling simplified facility use include: elevations for toilet seats and bathroom sinks, placement and design of grab bars and faucet handles, design of a "step-in" bathtub or shower, and so on.

Typical additions to a house are custom built and permanent in nature, involving substantial modifications to at least one exterior wall, and often to a roof as well. Such house additions are expensive in general, and can be cost prohibitive given that the addition is only needed for a relatively short period of time relative to the usable lifetime of the house—over which time ownership will change a number of times. Because only a small fraction of potential home buyers will want an addition such as those contemplated in the present disclosure, the resale value of the house is generally reduced by the addition even though it added substantially to the basis cost of the house.

The prior art discloses some concepts for lowering the cost of home modification to accommodate the special needs of disabled, handicapped, or partially-abled (limited ability) residents.

For example, inventors have disclosed ways to convert a portion of an existing interior room of a residence into a bathroom to accommodate handicapped individuals. This provides a ground floor bathroom, which avoids negotiating steps, but is severely limited to use in houses that have enough disposable living space on the first floor to accommodate an intra-room, modular bathroom.

U.S. Pat. No. 4,238,858 describes a walk-in ablution or toilet compartment formed from a few standardized construction elements which are light and can be transported into living rooms independently of the width of door openings, and can there be assembled together, and which can be provided with several desirable living facilities, e.g. for washing, for bathing, and for use of a toilet, while for each of the individual functions a separate space can if desired be provided within the compartment.

U.S. Pat. No. 4,899,402 describes a modular handicap-accessible bath facility that is constructed within an existing interior space of a home or building.

U.S. Pat. No. 5,652,976 provides a prefabricated and pre-plumbed modular invalid bathroom unit which has wheelchair access for installation in a first floor room for the invalid. The unit may be assembled in a first floor room and disassembled and removed when no longer needed.

Modular prefabricated (factory built) rooms are well known, and can reduce cost of adding a room outside of an existing structure, or more commonly, for quickly building a new structure such as a dormitory or motel where a plurality of identical rooms are needed.

For example, U.S. Pat. No. 3,110,907 (King, Nov. 19, 1963) discloses a fully unitized, prefabricated bathroom structure which may be shipped as a completed unit for on-site integration within the interior of a new building structure. Pre-installation of utilities (water, sewer, electric) enable simplified connection with main utility lines while requiring only a minimum of installation time and effort.

For example, U.S. Pat. No. 4,788,802 (Wokas, Dec. 6, 1988) discloses a transportable prebuilt room-forming module for external attachment to the exterior of a building. The disclosure focuses on details of construction considered suitable for transport while reducing cost through use of standard lumber sizes, for example squeezing the floor plan into a 4 by 8 foot area to fit a single sheet of plywood. Rigid "sandwich" or "reinforced" floor and roof members interconnect the walls of the room to provide strength. However, the walls and roof member are constructed using 2×4 studs and joists, with the front wall being only 2" thick. The module arrives at the point of installation with a plywood exterior. Final external construction is completed on site after it is placed on a permanent foundation. The front wall has a doorway for aligning with a doorframe installed in the house's exterior wall. The front wall is permanently attached along its entire width and height to the exterior house wall. A plumbing tree of sewage lines is preinstalled with a common outlet conduit projecting through a hole in the front of the floor member for connection to the house sewer system.

In another example, U.S. Pat. No. 2,644,203 (Donahue, Jul. 7, 1953) discloses a prefabricated bathroom structure which can be connected to a building, such as a rural residence, not previously provided with a bathroom, easily, quickly and without the requirement of special skill or the incurring of great expense. A further object is to provide a novel structure for attaching a prefabricated building structure to an old building structure and for sealing the horizontal and vertical joints between said structures effectively against wind and weather (using trim strips, flashing, caulking and a flat bottom periphery for sealingly resting on a sill plate provided on a foundation wall). A further object is to provide a novel, prefabricated, single room structure adapted to be connected or attached to another building, and characterized by a strong, light weight, insulated construction, which can be transported or shipped conveniently as a unit (using light weight construction such as 2×4 stud walls), and which is further characterized by the incorporation therein of plumbing and electric service lines and plumbing and electric fixtures, so arranged as to be protected against damage during shipment and installation of the structure, insulated against freezing in cold weather, and readily connected with plumbing and electrical lines serving the building to which the structure is attached. To this end, the preinstalled plumbing and electric lines are connected to common connection points provided in a box-like structure that encloses an opening all the way through the floor structure to access the inside of the foundation crawl space from inside the bathroom. The crawl space is surrounded by a permanent foundation wall like that of the residence, through which a hole is cut to allow passage of plumbing and electric lines from the residence for connection to the bathroom structure's connection points. The front wall has a doorway for aligning with a doorframe installed in the residence's exterior wall. The front wall is permanently attached and sealed along its entire width and height to the exterior house wall.

Thus there is an unmet need for a cost effective temporary addition to a residence (house) that provides missing living space and facilities on a ground floor level. Preferably the addition is ADA compliant.

A particularly suitable addition will provide an elderly and/or physically disabled person with sufficient space and facilities including a full bathroom or bedroom, optionally with laundry facilities, for ground floor living and sleeping. An ADA compliant temporary house addition will provide the necessary wheelchair space that can be comfortably negotiated alone or with the assistance of a caregiver.

BRIEF SUMMARY OF THE INVENTION

For elderly, handicapped or partially-abled house residents, a lack of accessibility to a ground floor bathroom, shower, bedroom/sitting room and/or laundry designed to be negotiated by a person utilizing a walker or wheelchair increases their dependence on others as well as increases safety risks, such as falls while attempting to reach needed facilities on another floor level.

The present invention relates to additional residential living space and facilities, and more specifically to a prefabricated, transportable, room addition, preferably ADA-compliant, for providing a private bedroom/living area or a full bathroom with a shower, sink and toilet; optionally including laundry facilities, that is quickly connectable to a user's house, providing ground floor access to living facilities for the elderly or those with physical limitations only as long as they need them.

Additionally, a nominally 36 inch wide outside door may be provided to accommodate an attached wheelchair ramp for wheelchair access/egress in and out of the home through the attached room addition if existing outside doors in the home are not wide enough. The door can also be used to provide rear access to the house if an existing rear door is temporarily blocked by the addition.

Important aspects of the inventive house addition are an attachment collar structure and corresponding methods for house attachment/installation.

Advantageously, the prefabricated temporary house addition can be attached and detached (installed/removed) from the residence without major re-construction, due to the minimized attachment area of a connecting collar and preferably also due to a simple four-pier foundation, thereby enabling relatively quick, easy and cost effective modification of the residence followed by returning the residence to its original pre-modification state.

In a preferred embodiment, the prefabricated addition is set on a temporary foundation of piers then connected to an existing home through the connecting collar. The connecting collar forms a bridge, by way of the smallest possible surface area, from the existing home to an ADA compliant addition.

The addition is pre-plumbed and wired with access points at its base. The addition's utilities are connected through the existing home's basement or subfloor using conventional supply lines but releasable and reusable connectors/couplings.

According to an embodiment of the invention a prefabricated house addition is provided for temporary removable attachment to a user's house in order to provide the user with living facilities on a ground floor level during a limited time period when the user cannot readily access said living facilities that are only available on another level of the user's house. The prefabricated house addition comprises a factory-built, substantially enclosed structure comprising: a room having a floor section, a front wall, a back wall, two side walls, and a roof section; all being interconnected and suitably constructed according to applicable building codes for an outdoor structure attached to a residential building; and a collar extending forward from the front wall and comprising: a hallway that passes through the front wall to define a passageway that is open at a distal forward collar end and is surrounded by a collar floor section extending the room's floor section forward, two collar side walls and a collar roof section; all being joined with the front wall to form suitable exterior corner joints and substantially right angle interior wall corners; outside collar dimensions of collar height OH and collar width OW that are minimized but limited by a hallway width W between interior surfaces of the collar side walls, and a flooring-to-ceiling hallway height H, that are no smaller than applicable residential building code minimum values for width and height of a passageway to be used by one adult at a time; and a marriage joint around the hallway at the distal forward collar end that provides a substantially planar, forward-facing surface on the collar side walls, floor section and roof section; thereby enabling simplified, removable temporary joining of the prefabricated house addition to a user's house wherein modification of the user's house is minimized.

According to an embodiment of the invention the prefabricated house addition is a temporary room suitable for providing various living facilities as needed, including bathroom, laundry, bedroom, sitting room, and an entrance to the house with a wheelchair ramp.

Preferably hallway height H and width W are approximately equal to ADA minimum values, thereby maintaining wheelchair access while minimizing collar dimensions.

Preferably living space and facilities of the prefabricated house addition are structured according to ADA standards for use with a wheelchair. Further preferably an external door is provided passing through a side or rear wall, optionally having provisions for handicapped access features such as a ramp, elevator, low pitch steps, and the like.

According to an embodiment of the invention the prefabricated house addition's collar has an outside length OL from outside of the front wall of the room to the marriage joint at the distal forward collar end such that the front wall is suitably spaced apart from the user's house and projecting features thereof. A collar extension may be provided to add to a standard prefabricated collar outside length OL.

According to embodiments of the invention the prefabricated house addition provides a compressible sealing gasket at the marriage joint for sealing the joint between addition and house. Furthermore, lag bolts or screws (not nails) are used to removably join the addition to the user's house.

According to an embodiment of the invention site preparation for installation of the prefabricated house addition includes constructing a mating surface for the marriage joint on an exterior house wall, wherein the mating surface surrounds a doorway built into the wall then framed by a header board above and a header-like mating board on either side—all secured with a broad face of the board secured against the inside of the house wall's sheathing to provide support and strengthening extra thickness for the marriage (attachment) of the collar and the house wall. Further preparation includes attaching a ledger on the house wall positioned suitably for supporting the collar by the bottom of its floor section to hold the collar flooring at an elevation above grade that matches the house ground floor's elevation. The room portion of the addition is similarly supported on a foundation structure provided under a perimeter of the room floor section.

According to an embodiment of the invention the prefabricated house addition site preparation uses four corner posts for the foundation. Preferably, as allowed by applicable building codes, the foundation is four helical screw piles positioned at four corners of the room, thereby enabling a relatively inexpensive temporary foundation that is quickly installable and removable with a minimal impact on the installation site.

According to an embodiment of the invention the prefabricated house addition is factory built using robust construction methods and materials, thereby providing a re-usable unitary structure capable of a plurality of transport, lifting, installation, short-to-medium term use, and removal cycles. Robust construction includes any combination of: 2×6 exterior wall studs with a double top plate, OSB sheathing for exterior wall sheathing, roof decking and floor decking (which is preferably also tongue and groove); doubled or LVL joist headers and stringers, flexible rubber membrane roofing material; engineered trusses in the roof section; and solid blocking of floor joists.

According to an embodiment of the invention the prefabricated house addition has a welded metal frame affixed around the floor joist headers and stringers of both the room and the collar. Advantageously, fork lift channels, a metal sill, and/or pier end caps can be affixed to the metal frame.

According to an embodiment of the invention the prefabricated house addition is pre-wired and pre-plumbed to supply utilities suitable for the facilities being provided by the addition. Advantageously, a localized utility connection point is inside the floor section near the front of the collar; and releasable and re-usable utility connectors/couplers are used.

According to an embodiment of the invention the prefabricated house addition has insulation in the floor section protected by a bottom board, plus an insulated skirt (wall) around the area below the addition.

According to an embodiment of the invention the prefabricated house addition includes a sewage pump if needed for waste water handling.

According to an embodiment of the invention the prefabricated house addition is provided as a split unit in two or three sections longitudinally cut to align with the outside of a side wall of the collar, thereby enabling transport through narrow passages followed by on-site assembly.

Other objects, features and advantages of the invention will become apparent in light of the following description thereof.

BRIEF DESCRIPTION OF THE DRAWINGS

Reference will be made in detail to preferred embodiments of the invention, examples of which are illustrated in the accompanying drawing figures. The figures are intended to be illustrative, not limiting. Although the invention is generally described in the context of these preferred embodiments, it should be understood that it is not intended to limit the spirit and scope of the invention to these particular embodiments.

Certain elements in selected ones of the drawings may be illustrated not-to-scale, for illustrative clarity. The cross-sectional views, if any, presented herein may be in the form of "slices", or "near-sighted" cross-sectional views, omitting certain background lines which would otherwise be visible in a true cross-sectional view, for illustrative clarity.

Elements of the figures can be numbered such that similar (including identical) elements may be referred to with similar numbers in a single drawing. For example, each of a plurality of elements collectively referred to as 199 may be referred to individually as 199*a*, 199*b*, 199*c*, etc. Or, related but modified elements may have the same number but are distinguished by primes. For example, 109, 109', and 109" are three different elements which are similar or related in some way, but have significant modifications. Such relationships, if any, between similar elements in the same or different figures will become apparent throughout the specification, including, if applicable, in the claims and abstract.

The structure, operation, and advantages of the present preferred embodiment of the invention will become further apparent upon consideration of the following description taken in conjunction with the accompanying drawings, wherein:

FIGS. 1A, 1B, and 1C are elevation views of a first side wall, a second side wall, and a front, respectively, of a prefabricated temporary house addition according to the invention.

Figure 2:
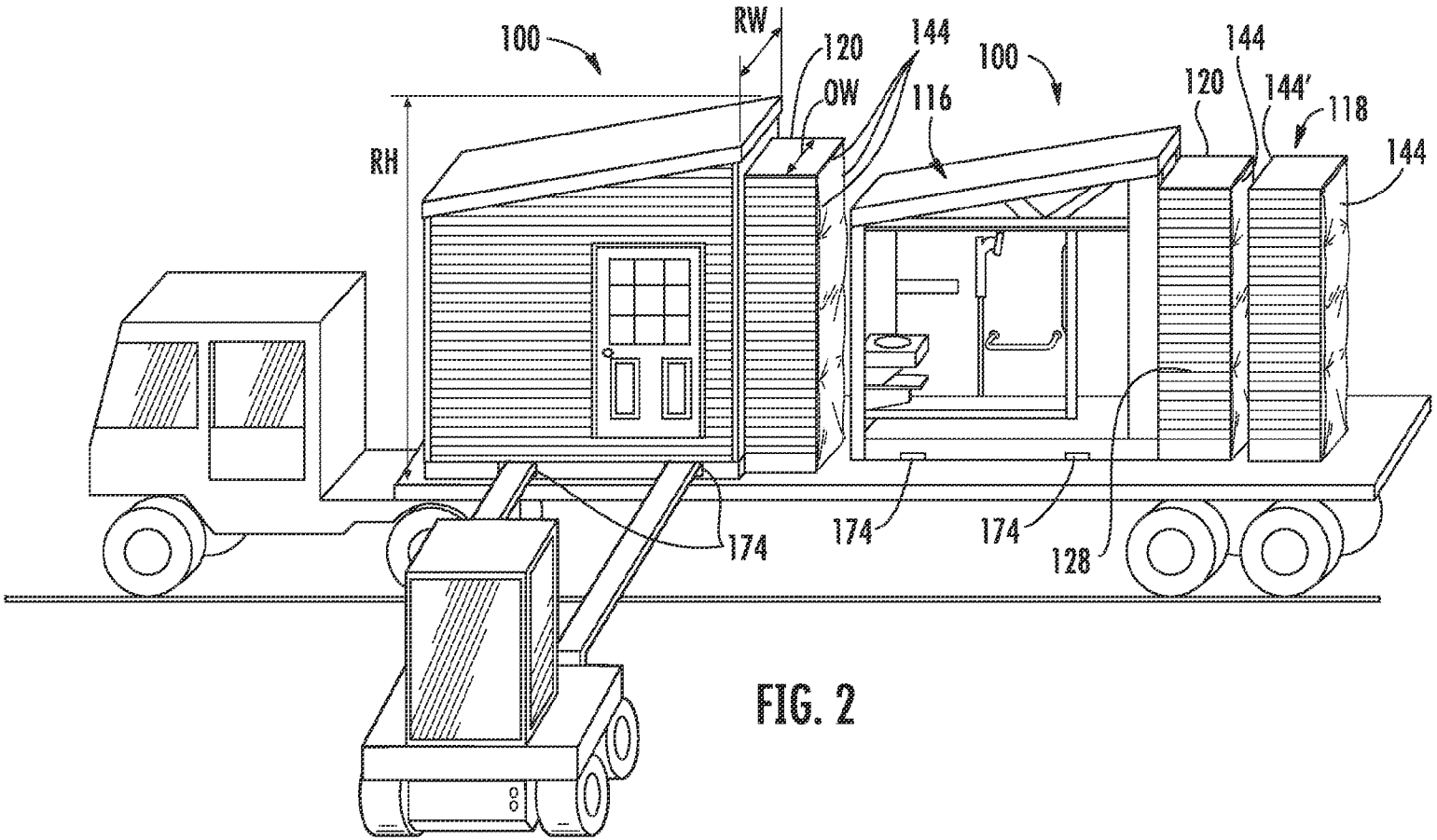

FIG. 2 is a perspective side view of a prefabricated addition and portions thereof being transported according to the invention.

Figure 3A:
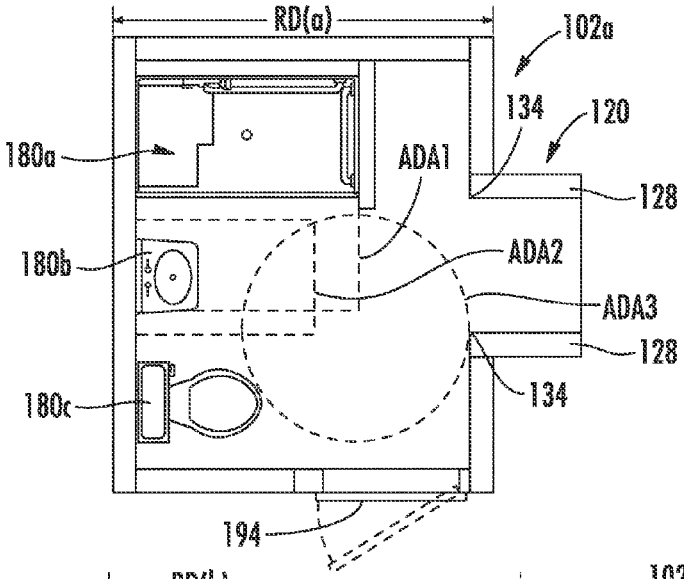
Figure 3B:
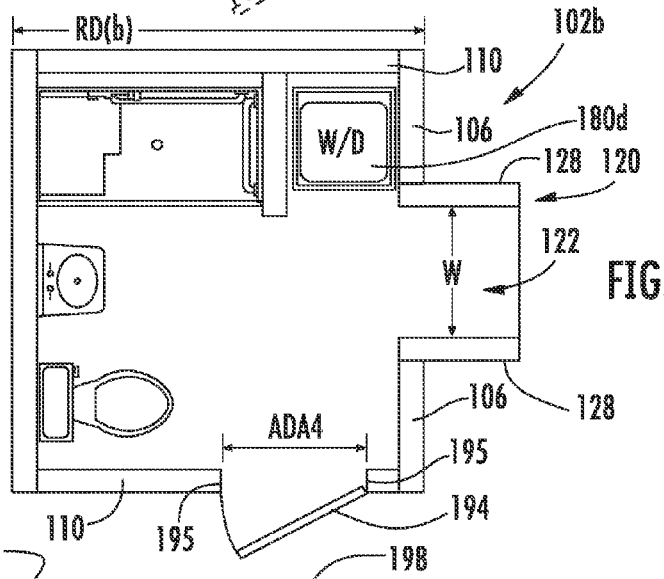
Figure 3C:
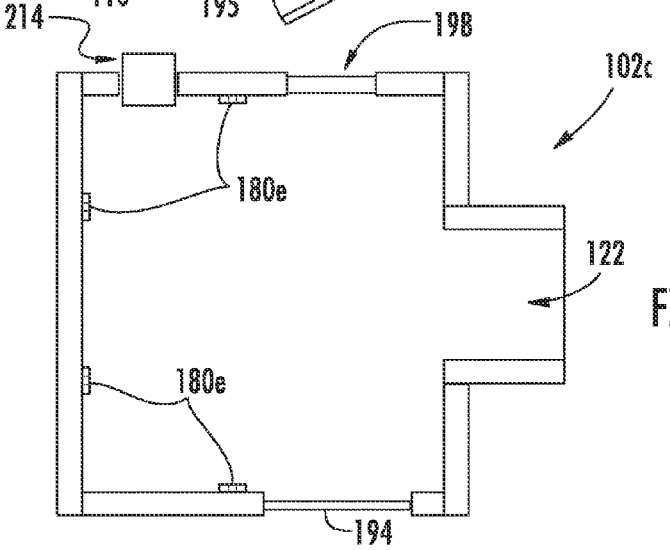

FIGS. 3A, 3B, and 3C are plan views of three embodiments of a prefabricated addition according to the invention.

Figure 4A:
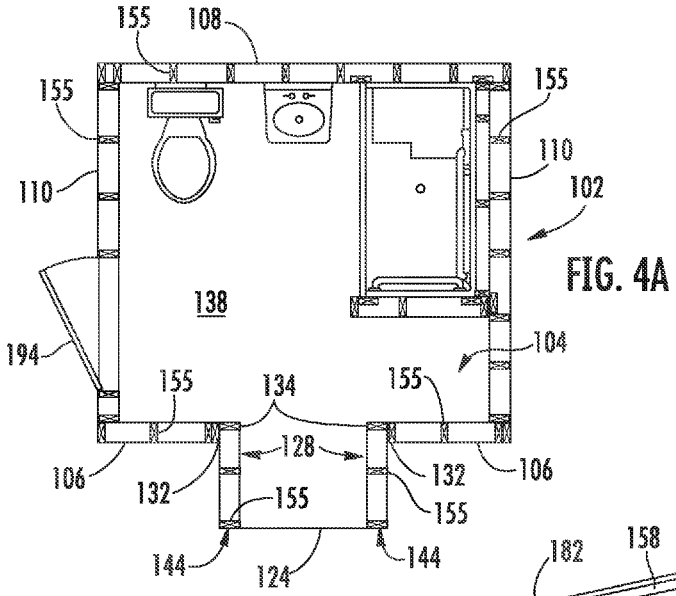
Figure 4B:
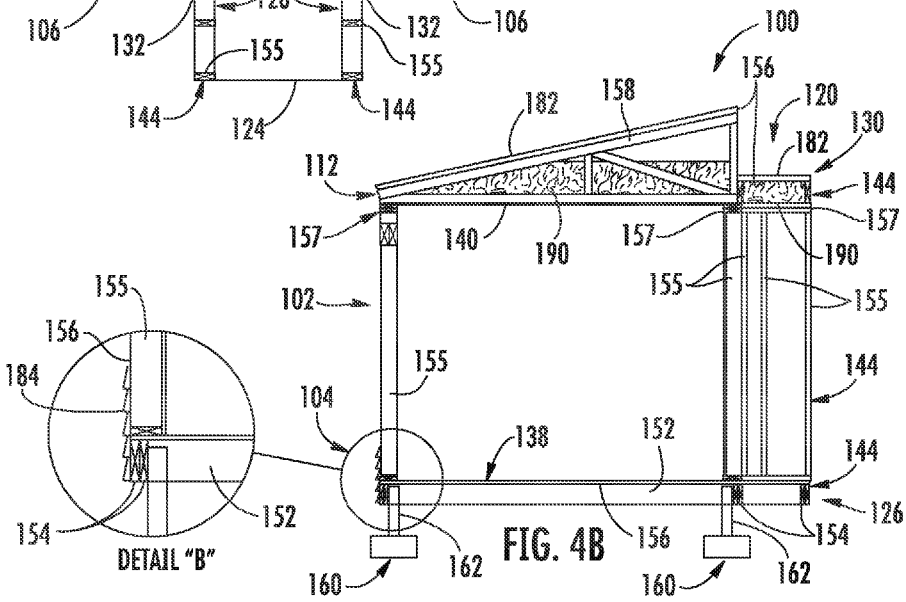
Figure 4C:
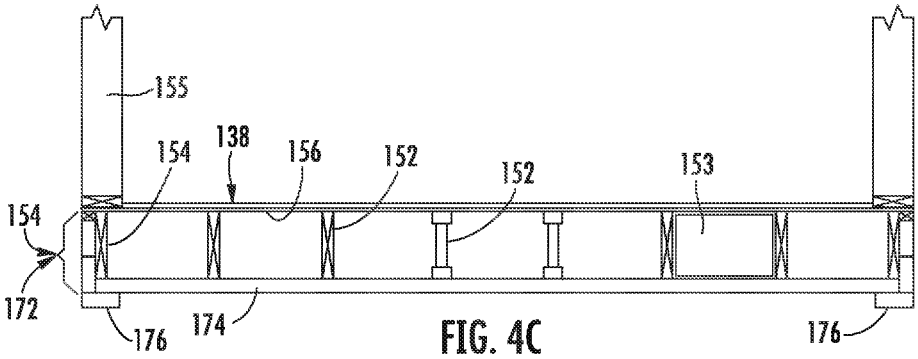

FIGS. 4A, 4B, and 4C are a top cross-section, a front-to-back side cross-section, and a partial side-to-side cross-section, respectively, of representative embodiments of the prefabricated addition according to the invention.

Figure 5:
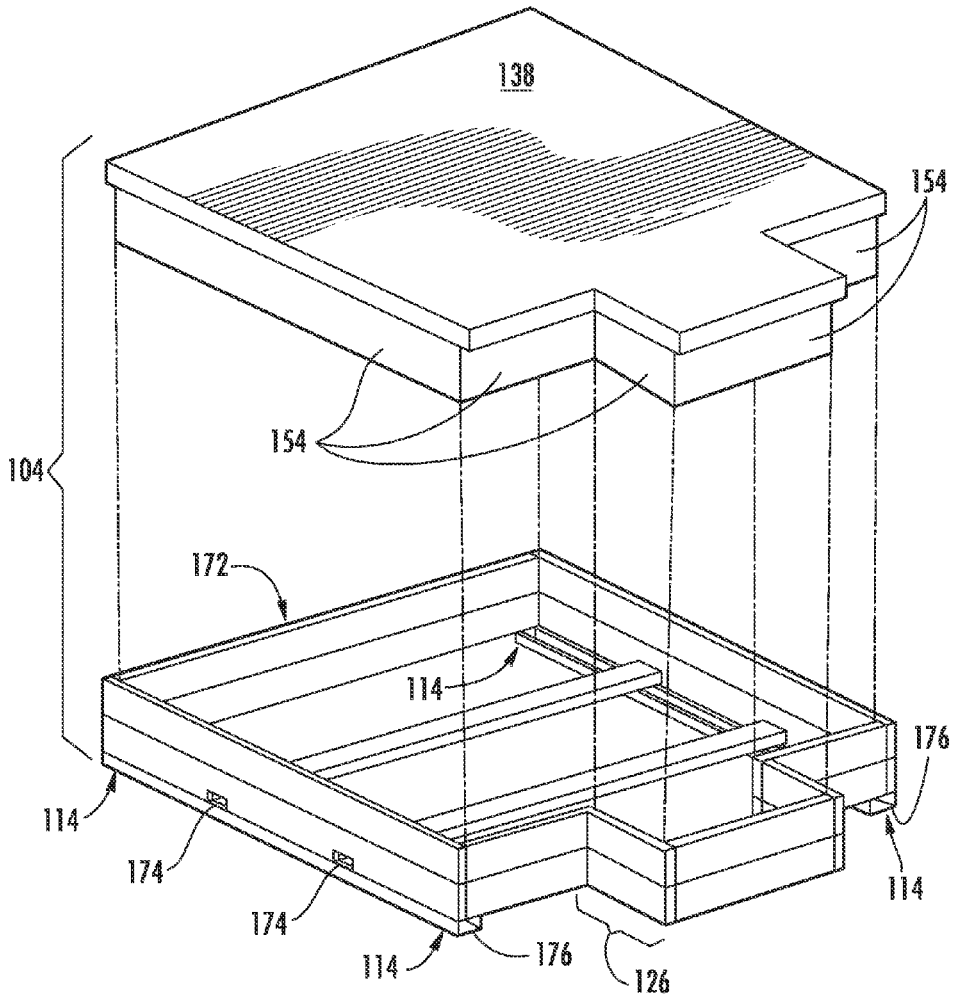

FIG. 5 is a perspective exploded view of a floor portion of an embodiment of the prefabricated addition according to the invention.

Figure 6:
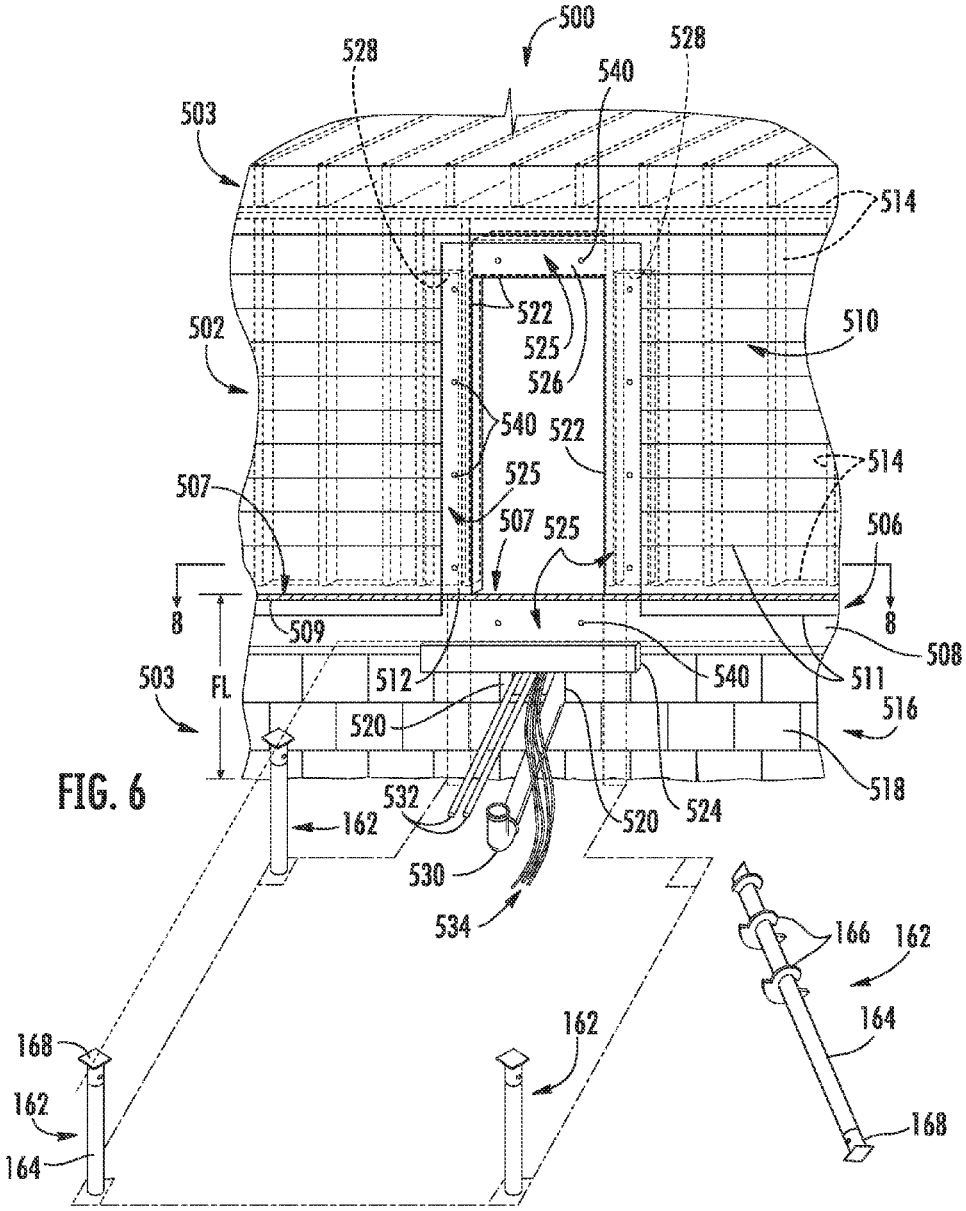

FIG. 6 is a perspective view of a user's house (wall structure shown ghosted behind house sheathing and siding) showing site preparation for temporary installation of the prefabricated addition according to the invention.

Figure 7A:
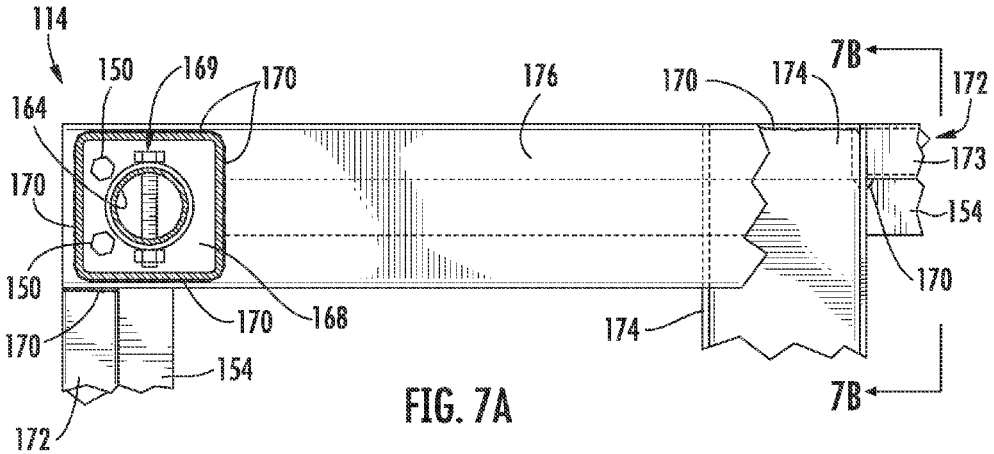
Figure 7B:
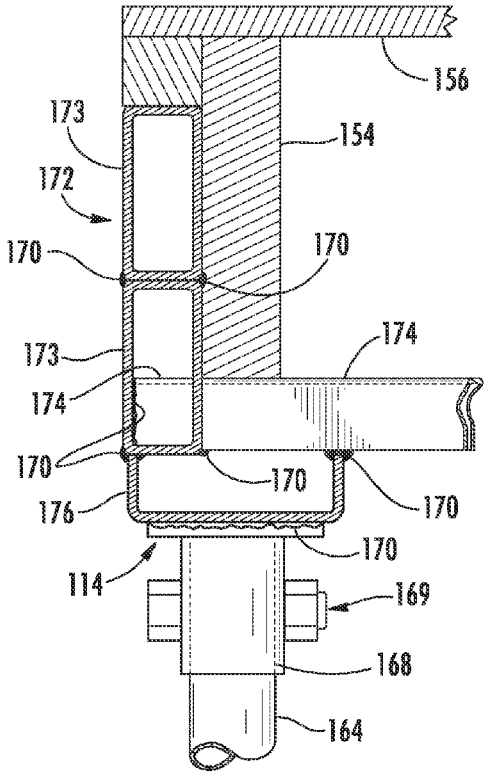

FIGS. 7A and 7B are a bottom view and a side cross-section of a portion of a metal framed embodiment of the prefabricated addition, showing attachment of a pile type of foundation according to the invention.

Figure 7C:
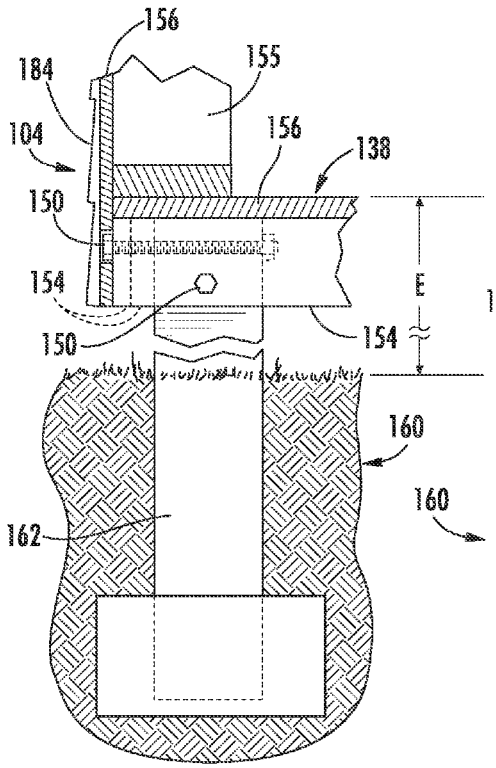
Figure 7D:
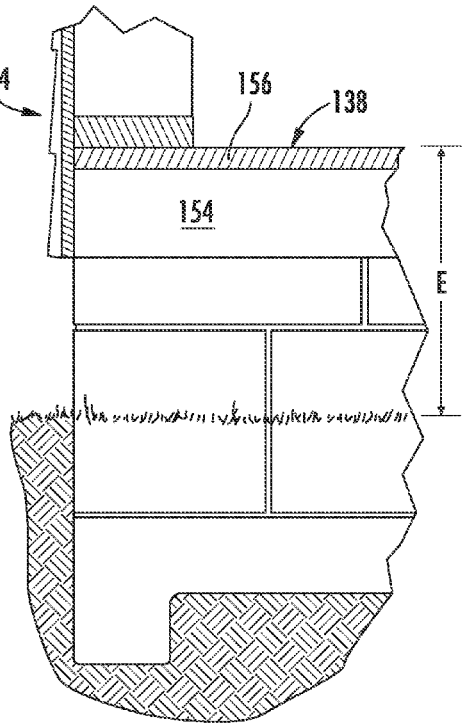
Figure 7E:
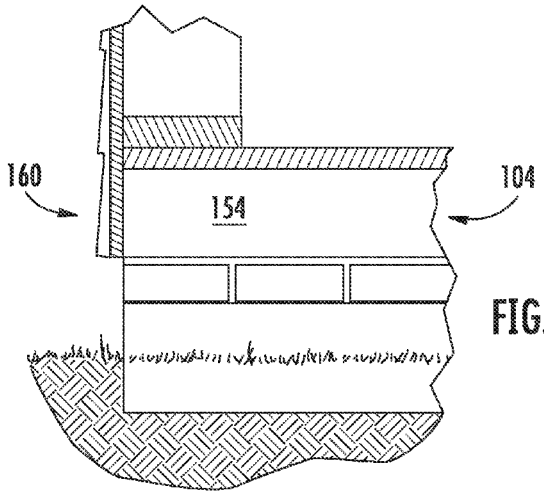

FIGS. 7C, 7D, and 7E are side cross-section views of exemplary suitable foundations supporting a corner portion of the prefabricated addition according to the invention.

Figure 8:
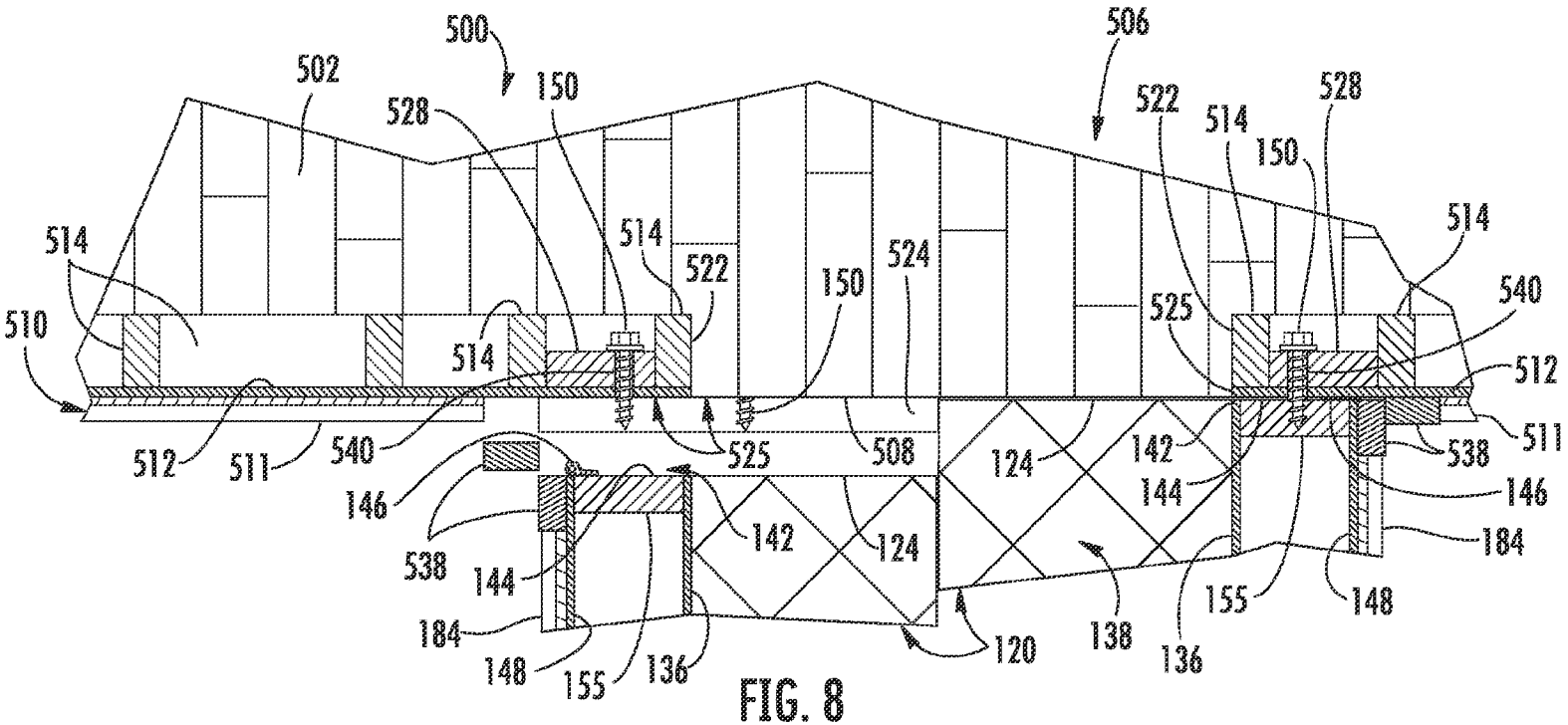

FIG. 8 is a magnified horizontal cross-section top view taken along the line 8-8 in FIG. 6 showing a portion of the house wall prepared for installation, plus a marriage joint portion of the prefabricated addition that is longitudinally split to show before and after views of marrying the house and the addition according to the invention.

Figure 9:
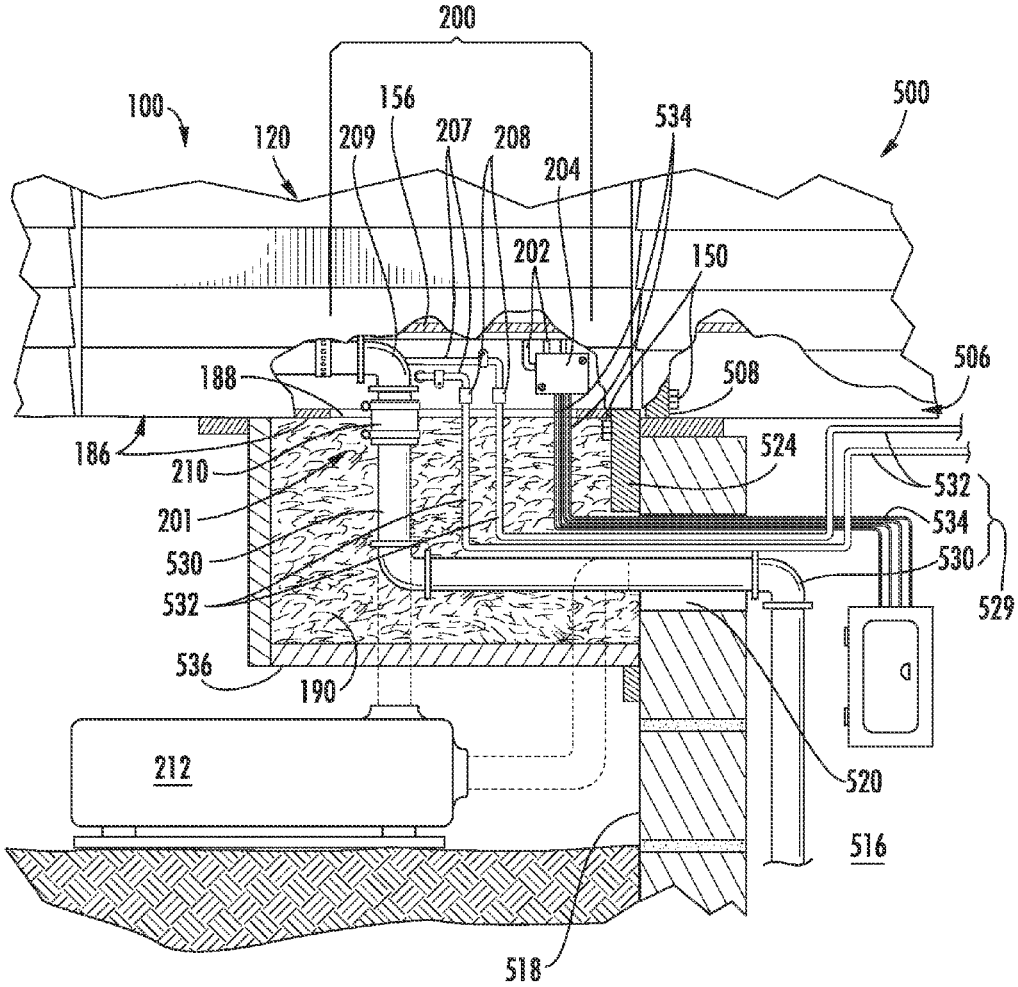

FIG. 9 is a side cross-section view with cutouts of subfloor, basement and foundation portions of the prefabricated addition married to the user's house, showing on-site utility connections according to the invention.

Figure 10:
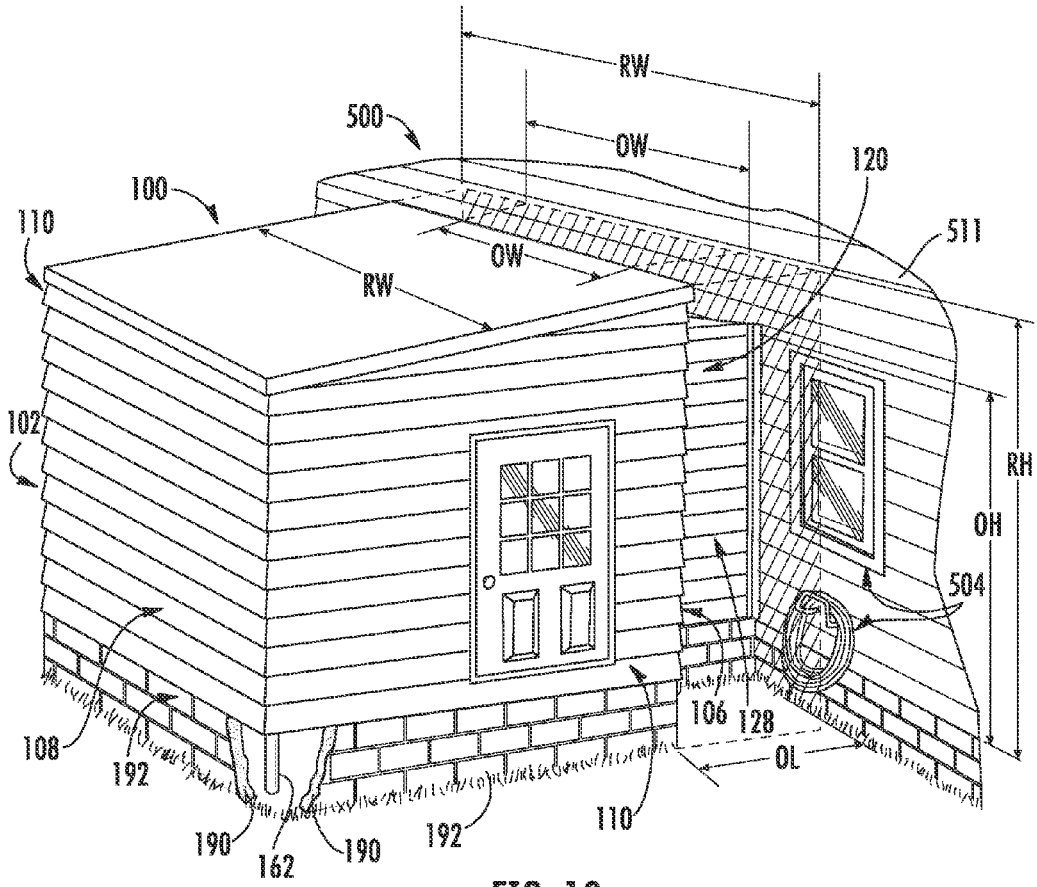

FIG. 10 is a raised perspective view of a finished installation of the prefabricated addition on a user's house according to the invention.

DETAILED DESCRIPTION OF THE INVENTION

Although adding a room to a house is not new, the present disclosure will describe embodiments of novel improvements incorporated in the design and method of installation of an inventive prefabricated temporary house addition (the addition 100). It can be seen that the addition 100 is particularly suited for satisfying a heretofore unmet need of handicapped, partly disabled, ill, or infirm house residents for a temporary addition providing needed living space and facilities, and that is easily installed and later removed with minimal impact on the house and yard and resultant property resale value.

Therefor the inventive addition 100 is prefabricated to simplify installation, is constructed for transport to and from an existing residential house location, and incorporates features that enable re-use of a particular addition at a plurality of residential sites.

Referring to FIGS. 1A-1C, 4A-4C, 8 and 10, the prefabricated house addition 100 is a factory-built, substantially enclosed structure including a room 102 having a floor section 104 underneath, a roof section 112 above, and surrounding front wall 106, back wall 108, and two side walls 110; all being interconnected and suitably constructed according to applicable building codes for an outdoor structure attached to a residential building (e.g., user's house 500). An important feature of the inventive addition 100 is a collar 120 that enables simplified, removable temporary joining of the prefabricated house addition 100 to a user's house 500 wherein modification of the house 500 is minimized while still providing easy access from the house 500 to a living space (room) 102 in the addition 100. The collar 120 extends forward from the front wall 106 and comprises: a hallway 122 that passes through the front wall 106 to define a passageway that is open at a distal forward collar end 124 and is surrounded by a collar floor section 126 extending the room's floor section 104 forward, two collar side walls 128 and a collar roof section 130, all being joined with the front wall 106 to form suitable exterior corner joints 132 and substantially right angle interior wall corners 134. The collar has outside dimensions of collar height OH (from a bottom board 186 beneath a collar floor section 126 to roofing 182 on top of a collar roof section 130) and collar width OW (between exterior wall coverings 148 on two collar side walls 128) that are minimized but limited by a hallway width W between interior surfaces 136 of collar side walls 128, and a flooring 138-to-ceiling 140 hallway height H, that are no smaller than applicable residential building code minimum values for width and height of a passageway to be used by one adult at a time. In preferred embodiments, the hallway height H and width W are approximately equal to ADA minimum values for use by a person in a wheelchair. For example, the ADA minimum width for a hallway is 36 inches or 32 inches for a short portion, like a doorframe.

The collar 120 has an outside collar length OL measured from a front wall 106 of the addition 100 to a distal forward collar end 124, which presents a substantially planar, forward-facing surface 144 on the collar's side walls 128, floor section 126 and roof section 130. This planar surface is a marriage joint 142 for attaching the addition 100 to the house 500 by sealing against a site-prepared corresponding planar mating surface 525 (FIGS. 6 and 8). Preferably a good seal is formed by a releasable sealing gasket 146 rather than caulking In a test unit we will use a "Barrier Seal" product that is specifically sold for use in "marriage joints" of factory built modular and double wide manufactured homes. Also known as "bulb seal", the ITP sealing gasket 146 is a longitudinally extending strip with a P-shaped cross-section made of a "highly compressible, non-gassing, engineered polymer foam." This embodiment of the sealing gasket 146 is available from Industrial Thermo Polymers Ltd. (ITP), of Brampton, Ontario, Canada.

Also shown in FIG. 1A is an exterior door 194 that is shown with an optional wheelchair ramp 196, this being but one example of a number of provisions that can be made for handicapped access such as a ramp, elevator, low pitch steps, and the like. The door 194 is nominally 36 inches wide and the ramp 196 is suitably made to accommodate wheelchair access/egress in and out of the home 500 through the attached room addition 100 if existing outside doors in the home are not wide enough. The door 194 can also be used to provide rear access to the house if an existing rear door is temporarily blocked by the addition 100.

Nevertheless, FIG. 10 shows that spacing the addition 100 apart from the house 500 by the collar length OL, and by only covering a minimized area (collar width OW by collar height OH) then very little of the house siding 511 is disturbed and functional presence of projecting house features 504 such as windows, doors and hose faucets, for example, are retained. A "shadow" drawn on the house 500 shows that without the collar 120, attachment to the house 500 of the entire width RW and height RH of the front wall 106 of the addition would require removal or boarding up of the window feature 504 and removal or moving of the faucet feature 504.

FIG. 2 illustrates some aspects of the prefabricated temporary house addition 100 that enhance its portability and facilitate its re-use. The room width RW and room height RH are suitable for transport on truck beds (e.g., width RW of 9'-9", and height RH of about 11'-9"). To accommodate a narrow residential driveway, a longitudinally split addition 100 can be prefabricated like a "double wide" house trailer. For example, FIG. 2 shows a split portion 116 that is separated from the nearest third of the addition along a line parallel to a collar side 128.

Preferably as shown, fork channels 174 are built into the addition 100. These are heavy gauge structural metal channels (e.g., 5 gauge steel) that extend completely across the room width RW under the floor section 104 (see FIGS. 5 and 7A-B), thereby spreading out the forces imposed by lifting the addition 100 on forklift truck forks. Furthermore, the fork channels 174 are sized and shaped to confine a forklift fork above and on both sides in order to minimize wobbling and shifting of the addition 100 while it is carried from truck bed to installation site and also while it is being precisely positioned against the house 500 and on a foundation 160 of the addition 100 that may comprise only four narrow posts 162 (see FIG. 6).

An optional component for the addition 100 is a collar extension 118 that duplicates the collar 120 structure except for additionally having a rearward facing planar surface 144' that is suitable for use like a house mating surface 525 for marrying with the forward facing marriage joint of the standard collar 120. As with the house mating surface 525, through holes 540 can be provided in the rear face 144' for enabling the use of lag screws or lag bolts/nuts 150 to secure the collar extension 118 to the collar 120. The collar extension may be provided in several standard collar lengths, or could be custom made for specific installations.

FIGS. 3A-3C show floor plans for three examples of rooms 102 that can be provided by additions 100 to supply temporary living facilities to meet various needs. FIGS. 3A and 3B show two bathrooms 102*a* and 102*b*, the main difference being that the second bathroom 102*b* also has a washer and dryer 180*d* as an extra living facility 180, in addition to a step-in shower 180*a*, a lavatory/sink 180*b*, and a toilet 180*c*. In preferred embodiments the living facilities are all ADA compliant, and also the arrangement of facilities 180 in the room comply with ADA standards for movement in a wheelchair. For example, ADA3 indicates a 5 foot diameter circle for allowing a 360 degree turn. Likewise, ADA1 and ADA2 indicate minimum required open spaces for use of the shower and sink facilities. It can be seen that suitable handgrip bars are provided where needed. In FIG. 3B, ADA4 indicates the ADA compliant doorway width (nominal 36", minimum 32"). The hallway 122 in the collar 120 has a width W that is substantially 36" wide.

It can be seen that by leaving out the laundry facilities 180*d*, the room depth RD can be reduced from RD(b) to a smaller dimension RD(a), while still maintaining ADA compliance. FIG. 3C shows a multipurpose room 102*c* which can be used as a bedroom and/or sitting room or otherwise private area. An air conditioner 214 and/or a window 198 may be provided. Likely facilities 180*e* would include, at a minimum, properly spaced electrical outlets, for example.

FIG. 5 illustrates an extra base framing for strength, portability: a metal support frame with addition "exploded" above it, lined up for assembly.

FIG. 6 shows site preparation for installation: Perspective view—a doorframe installed in outside wall of house. Lap siding removed from wall around it and header/mating boards/ledger board installed around it. Three helical pier posts in place, one lying on ground. Hole in basement wall below ledger, with bundle of wires, two water lines, and a sewer line extending out from it.

FIG. 7A-B show how a helical pile cap with mounting plate is welded to bottom of metal sill, (alternatives include pile cap to double wood rim joists/lag screws, and metal sill on wood frame) 7C is a 6×6 wood post in buried cement bolted into inside corner of floor rim joists, D=standard cement block wall on buried poured foundation, E=concrete slab with joists resting on a single brick riser.

FIG. 8 is marriage joint: top view of horizontal X-section, magnified to show portions of married (installed) collar end and house wall at doorframe. Shows P-seal flattened between flat collar end face and header above plus "mating boards" either side of door frame, flush with outside of house sheathing. Shows AZEK trim boards sealed against house siding. Shows bolts or lag screws removably holding joint together.

FIG. 9 shows utility connections/foundation insulation: side Xsection view of installed addition, magnified to show collar floor and down to ground, hole in basement wall, and part of basement. Shows ledger board supporting end of collar floor, utility supply lines from basement thru hole, connections together under floor of collar. Identifies releasable reusable connections. Shows insulation in floor, bottom board, and optional ejection pump.

Referring to FIGS. 4A-5, The prefabricated house addition 100 is factory built using robust construction methods and materials, thereby providing a re-usable unitary structure capable of a plurality of transport, lifting, installation, short-to-medium term use, and removal cycles. Robust construction includes any combination of: 2×6 exterior wall studs 155 with a double top plate 157, OSB sheathing for exterior wall sheathing 156, roof decking 156 and floor decking 156 (which is preferably also tongue and groove); doubled or LVL joist headers and stringers 154, flexible rubber membrane roofing material 182; engineered wood or metal trusses 158 in the roof section 112; and solid blocking 153 of floor joists 152. Optionally the roof section 112 is constructed a 3-12 pitch shed roof, but could also be a peaked roof. The trusses as well as joists are secured both by nails and by hanger brackets. The roof may be finished with underlayment, asphalt shingles or metal-standing seam roofing. The roof is vented by conventional means, and the roof cavity is insulated with an extra thick layer of either batt or blown-in insulation 190.

The exterior walls are constructed using 2×6 wood or metal studs 155 secured 16 inches on center. Drywall or other suitable products cover the interior side of the exterior walls; wood sheathing 156 covers the exterior side of the walls. The exterior walls are insulated with either batt or blown-in insulation (not shown). The exterior walls are finished with moisture barrier and vinyl or other suitable products.

The floor joists 152 are constructed with either 2×8 or (preferably) 2×10 wood or metal joists spaced 16 inches O/C. Open joists may be used in places to accommodate plumbing and the like. Insulation 190 preferably fills the space between the floor joists 152, headers and stringers 154. Wood decking 156 is applied to the top of the floor joists, then covered by finish flooring 138 such as vinyl or other suitable materials.

Referring to FIGS. 9-10, the underside of the floor joists 152 are covered with a suitable bottom board 186. When the preferred foundation of piers or posts 162 is used, the resulting crawl space is enclosed by a complete skirt 192 with insulation 190 applied from the bottom of the floor joists to grade level and extending completely around the addition 100 and connecting collar 120 after the plumbing and electrical connections are completed.

Two pre-plumbed ¾ inch copper or Pex tubing, plumbing lines run in the center of the addition between the floor joists. One supplies hot water to the sink, shower, and laundry, if present, and the second water line supplying cold water to the toilet, sink, shower, and laundry, if present. ½ inch hot and cold water supply lines branch off from the ¾ inch line at the point of termination into the bathroom fixtures. A third pre-plumbed 3 inch sanitary line runs next to the hot and cold water branches between the floor joists in the center of the addition. This 3 inch sanitary line has branches that are also 3 inch to pick up the sanitary waste from the toilet, sink, shower, and washer, if present. This 3 inch sanitary line has a 2 inch conventional venting loop from beginning to end that terminates through the roof.

The utilities 200: hot and cold water lines 207, the sanitary line 209 and the electrical wiring 202 end at a connection point 201 under the collar 120 but protected within it. Corresponding utility lines 529 from the existing home's plumbing and electrical lines are extended through a hole 520 cut in the foundation wall 518 to the point of connection 201.

Advantageously, releasable and re-usable utility connectors/couplers are used. For example, a Fernco Coupling 210 will be used to connect the PVC sanity line 209 to the house sewer line 530. Fernco couplings have earned a reputation for consistent, superior performance. The dimensional flexibility of Fernco couplings ensures leak-proof seals on virtually any pipe material: plastic, cast iron, asbestos cement, clay, concrete, steel, copper and ductile iron. The coupling is made of an elastomeric compound that meets the requirements of ASTM #D5926, C1173 and applicable portions of ASTM #C443, C425, C564, CSA B602 and D1869. It is leak-proof, root-proof and resistant to chemicals, ultraviolet rays, fungus growth, and normal sewer gases. Stainless steel clamps are corrosion-resistant and rust-proof.

The water lines 207 and 532 are preferably PEX plumbing lines for hot (red plastic) and cold (blue) water being connected to the supply lines 532 from the home with SharkBite reusable push-fit fittings 208. There is a SharkBite Disconnection tool that is used to disconnect the supply lines when the addition 100 is removed. Thus the fittings are re-usable (both water and sewer). SharkBite Couplings make fast and easy connections from PEX, copper, or CPVC with NO soldering, clamps, unions or glue required. SharkBite push-fit fittings are fittings that you can push the connector by hand onto the tube or pipe. Once pushed to the proper depth, you're done; no extra parts, soldering or tools are required. Watertight to 200 psi, approved for hidden use.

There are three pre-wired electrical circuits that supply an exhaust fan and lighting, a GFI (ground fault interrupter) outlet next to the sink, and the radiant heater. The exhaust fan and lighting circuit could also be on a GFI circuit. All three circuits are of conventional amperage and wattage. Two additional pre-wired circuits of conventional amperage and wattage are provided with suitable receptacles for laundry facilities, if present.

All pre-wired circuits are fed back to a junction box 204 between the floor joists of the connecting collar. Patch connections are made from the existing home's electrical panel to the junction box under the connecting collar to provide electricity. Standard wire nuts may be used as re-usable connectors.

Viewed in FIG. 3A, an ADA compliant walk-in shower and that is 60 inches wide and 30 inches deep is pre-installed. The shower seat is located 17-19 inches from the shower floor per ADA guidelines and extends the full depth of the shower stall. The controls for the hot and cold water and the lowest adjustable point for the flexible shower hose with handle are located between 38 and 48 inches from the shower floor. The hot and cold water controls and the shower handle are located no farther than 27 inches from the corner of the wall with attached seat. 1¼ or 1½ inch grab bars and are pre-installed throughout at proper ADA height between 33 and 36 inches from the floor. and are the 36×60 inch ADA approaches for this shower.

An ADA compliant raised toilet, is pre-installed with a seat height 17 to 19 inches from the floor. The flush control is located on the open side of the toilet. A 36 inch grab bar that is 1¼ or 1½ inches in diameter is pre-installed behind the toilet, and a 42 inch grab bar of the same diameter is pre-installed at the closed wall side of the toilet at proper ADA height between 33 and 36 inches from the floor and extends no farther than 54 inches from the wall behind the toilet.

A sink is pre-installed and mounted with counter or rim no higher than 34 inches above finished floor. Knee clearance is provided that is at least 8 inches under the sink where the height clearance is 27 inches. 17 inches of toe clearance from the wall is provided with a minimum height of 9 inches. The pipes under the sink are covered to prevent contact. The sink shall be a maximum of 6½ inches deep, and the faucet will have paddle handles. A tilt mirror is mounted no higher than 40 inches above the finish floor. and illustrate the 30 inch approach area for the sink.

The room 102*b* with space and utility connections providing for a laundry area is meant to receive either a washer and dryer from the existing home's basement or a washer and dryer purchased for the occupants level of functioning, i.e., occupant uses a cane, walker, or wheelchair. is the 30×48 inch approach areas to the washer and dryer.

A 5 foot turning radius is provided to comfortably make a 360 degree turn in a wheelchair. The entrance into the addition, connecting collar hallway, is 36 inches wide and. The width of the exit door and clear floor space to this exit door is 36 inches (somewhat reduced by trim and door hinge edge, but well over the minimum allowance of 32 inches).

FIGS. 6 and 8 illustrate the marrying of collar to house. The brick or siding would be peeled away to make room for the door framing. Install a ledger board 524 on the home where the frame for the hallway will rest for support.

The exterior will be finished with either AZEK trim for around doorway plus caulk or aluminum siding trim plus caulk. Azek is a moisture resistant trim board. From web page:

The plumbing that connects to the home after a hole is bored through the basement block may have a box 536 built around it so that the heat from the basement will pass through the bored hole and fill the box connecting the floor joists and the basement block. The box could also contain additional insulation 190.

If needed, a sewage ejector pump 212 is provided when gravity draining won't work.

Although the invention has been illustrated and described in detail in the drawings and foregoing description, the same is to be considered as illustrative and not restrictive in character—it being understood that only preferred embodiments have been shown and described, and that all changes and modifications that come within the spirit of the invention as claimed are desired to be protected. Undoubtedly, many other "variations" on the "themes" set forth hereinabove will occur to one having ordinary skill in the art to which the present invention most nearly pertains, and such variations are intended to be within the scope of the invention, as disclosed herein.

What is claimed is:

1. A prefabricated temporary house addition designed for transporting as a pre-constructed (Factory Built) re-usable modular structure to a user's residential house for removable temporary attachment thereto with a minimum amount of modification to the house and yard, thereby to provide the user with additional residential living facilities on a lower level of the user's house, wherefore the construction and appearance of the house addition is intended to be suitable for attachment to a house in a residential area; the prefabricated temporary house addition comprising:

a Factory-built housing module comprising a room portion and a collar portion fixedly assembled together and transported as a non-collapsible unitary structure; wherein: the room portion is self-enclosed by rigid building materials comprising: a floor, a roof, two side walls laterally spaced apart to a fixed room width RW, and a back wall and a front wall affixed between the side walls, the front wall having a doorway opening therethrough; and the collar portion is self-enclosed by rigid building materials comprising: a floor, a roof, and two side walls having a fixed collar length OL and being laterally spaced apart to a fixed collar width OW that is substantially less than the room width RW; and further wherein: the collar portion is unchangeably affixed to the front wall of the room portion surrounding the front wall doorway opening to provide a hallway longitudinally extending from the room to a distal collar front end opening; and the collar has a mating surface around the collar front end opening that adapts the collar for temporary joining of the prefabricated housing module to an exterior wall of the user's residential house around a doorway opening provided therethrough;

thereby minimizing modification of the user's residential house while making additional residential living facilities accessible by the user on a lower level of the house.

2. A method for temporarily providing a user with additional residential living facilities on a lower level of the user's residential house, while minimizing the amount of modification to the house and year; the method comprising the steps of:

Factory-building a housing module adapted for transporting to and from a user's residential house, and for removable temporary attachment thereto; the factory building step comprising fixedly assembling together a room portion and a collar portion for transporting as a non-collapsible unitary structure;

providing additional residential living facilities for the user wherein the room portion of the module is factory built with rigid building materials comprising: a floor, a roof, two side walls laterally spaced apart to a fixed room width RW and a back wall and a front wall affixed between the side walls, the front wall having a doorway opening therethrough;

providing a hallway in the collar portion for user access to the room portion, wherein the collar portion is factory built with rigid building materials comprising: a floor, a roof, and two side walls having a fixed collar length OL from a room end to a distal collar end opening, and being laterally spaced apart to a fixed collar width OW; and further wherein the room end of the collar portions unchangeably affixed to the front wall of the room portion, surrounding the front wall doorway opening; and minimizing the amount of modification to the user's residential house by factory building the housing module such that the collar width OW is substantially less than the room width RW of the room front wall, and the collar length OL spaces the module's front room away from an exterior wall of the user's house to enable temporary attachment of the module to the user's house by joining the smaller width OW collar distal end opening around a doorway opening cut through an exterior wall of the user's house.

3. The prefabricated temporary house addition of claim 1 further comprising:

robust construction of the Factory built housing module suitable for a re-usable unitary structure capable of a plurality of cycles that comprise: transport, lifting, installation, short-to-medium term use, and removal.

4. The prefabricated temporary house addition of claim 1, wherein the housing module is suitable for installation and use on a supporting foundation consisting of vertical posts supportingly attached under the four corners of the room portion of the housing module;

thereby minimizing modification of a yard area by the house.

5. The prefabricated temporary house addition of claim 1 wherein the Factory-Built housing module further comprises:

utilities and associated utility lines that are factory installed in the housing module; such that:

the utility lines are run to a localized connection point accessibility located in the collar portion under the hallway near the distal collar end opening; and ends of the utility lines at the connection point comprise releasable and reusable connectors/couplers.

6. The prefabricated temporary house addition of claim 1, further comprising:

interior dimensions that comply with ADA standards for wheelchair accessibility.

* * * * *